US011207794B1

(12) United States Patent
Brown

(10) Patent No.: US 11,207,794 B1
(45) Date of Patent: Dec. 28, 2021

(54) SYSTEMS AND METHODS FOR TRIMMING POWERED CARDS AND DEVICES

(71) Applicant: William Barry Brown, Cheswick, PA (US)

(72) Inventor: William Barry Brown, Cheswick, PA (US)

(73) Assignee: DYNAMICS INC., Pittsburgh, PA (US)

( * ) Notice: Subject to any disclaimer, the term of this patent is extended or adjusted under 35 U.S.C. 154(b) by 0 days.

(21) Appl. No.: 13/623,012

(22) Filed: Sep. 19, 2012

Related U.S. Application Data

(60) Provisional application No. 61/536,907, filed on Sep. 20, 2011.

(51) Int. Cl.

| | |
|---|---|
| ***B21D 28/12*** | (2006.01) |
| ***B21D 28/26*** | (2006.01) |
| ***B26F 1/14*** | (2006.01) |
| ***B26F 1/00*** | (2006.01) |
| ***B21D 28/00*** | (2006.01) |
| *B30B 15/28* | (2006.01) |
| *B21D 28/24* | (2006.01) |

(52) U.S. Cl.
CPC ..... *B26F 1/14* (2013.01); *B21D 28/00* (2013.01); *B21D 28/12* (2013.01); *B21D 28/26* (2013.01); *B26F 1/00* (2013.01); *B21D 28/24* (2013.01); *B30B 15/28* (2013.01)

(58) Field of Classification Search
CPC ... B26F 1/14; B26F 1/00; B21D 28/00; B21D 28/12; B21D 28/24; B21D 28/26
USPC ..... 83/684–691, 551–552, 162, 698.71, 83/698.91
See application file for complete search history.

(56) References Cited

U.S. PATENT DOCUMENTS

| | | | | |
|---|---|---|---|---|
| 2,387,027 | A * | 10/1945 | Jackson | 83/685 |
| 4,893,536 | A * | 1/1990 | Kinoshita | B21D 28/16 83/451 |
| 7,784,687 | B2 | 8/2010 | Mullen et al. | |
| 7,793,851 | B2 | 9/2010 | Mullen | |
| 7,828,220 | B2 | 11/2010 | Mullen | |
| 7,931,195 | B2 | 4/2011 | Mullen | |
| 7,954,705 | B2 | 6/2011 | Mullen | |
| D643,063 | S | 8/2011 | Mullen et al. | |
| 8,011,577 | B2 | 9/2011 | Mullen et al. | |
| 8,020,775 | B2 | 9/2011 | Mullen et al. | |
| 8,066,191 | B1 | 11/2011 | Cloutier et al. | |

(Continued)

FOREIGN PATENT DOCUMENTS

| | | | | |
|---|---|---|---|---|
| EP | 0005634 B1 * | 8/1982 | ..... | F16P 3/00 |

*Primary Examiner* — Kenneth E Peterson
*Assistant Examiner* — Nhat Chieu Q Do

(57) ABSTRACT

Cards may be manufactured in a lamination process, such that interior portions of the cards may be visible. Punch alignment queues within the card may be scanned by a punch machine and rendered onto a display of the punch machine. The punch alignment queues may be aligned with targets also rendered onto the display so that the card may be properly aligned within a punch machine to prepare the card for a trimming process. A Venturi system may temporarily adhere the card to a punch of the punch machine while the punch is engaged with a die to trim the card. The cutting surface of the die may be offset with respect to a surface of the punch, so that the card may be sequentially trimmed along a perimeter of the card.

9 Claims, 9 Drawing Sheets

300

(56) References Cited

U.S. PATENT DOCUMENTS

D651,237 S 12/2011 Mullen et al.
D651,238 S 12/2011 Mullen et al.
8,074,877 B2 12/2011 Mullen et al.
D651,644 S 1/2012 Mullen et al.
D652,075 S 1/2012 Mullen et al.
D652,076 S 1/2012 Mullen et al.
D652,448 S 1/2012 Mullen et al.
D652,449 S 1/2012 Mullen et al.
D652,450 S 1/2012 Mullen et al.
D652,867 S 1/2012 Mullen et al.
D653,288 S 1/2012 Mullen et al.
8,172,148 B1 5/2012 Cloutier et al.
8,201,435 B2 * 6/2012 Erlenmaier ..... B21D 28/24 72/442
D665,022 S 8/2012 Mullen et al.
D665,447 S 8/2012 Mullen et al.
D666,241 S 8/2012 Mullen et al.
8,282,007 B1 10/2012 Cloutier et al.
8,286,876 B2 10/2012 Mullen et al.
D670,329 S 11/2012 Mullen et al.
D670,330 S 11/2012 Mullen et al.
D670,331 S 11/2012 Mullen et al.
D670,332 S 11/2012 Mullen et al.
D670,759 S 11/2012 Mullen et al.
8,302,872 B2 11/2012 Mullen
D672,389 S 12/2012 Mullen et al.
8,322,623 B1 12/2012 Mullen et al.
D674,013 S 1/2013 Mullen et al.
8,348,172 B1 1/2013 Cloutier et al.
D676,904 S 2/2013 Mullen et al.
8,382,000 B2 2/2013 Mullen et al.
8,393,545 B1 3/2013 Mullen et al.
8,393,546 B1 3/2013 Yen et al.
8,413,892 B2 4/2013 Mullen et al.
8,424,773 B2 4/2013 Mullen et al.
8,459,548 B2 6/2013 Mullen et al.
D687,094 S 7/2013 Mullen et al.
8,485,437 B2 7/2013 Mullen et al.
8,485,446 B1 7/2013 Mullen et al.
8,511,574 B1 8/2013 Yen et al.
8,517,276 B2 8/2013 Mullen et al.
8,523,059 B1 9/2013 Mullen et al.
8,561,894 B1 10/2013 Mullen et al.
8,567,679 B1 10/2013 Mullen et al.
8,573,503 B1 11/2013 Cloutier et al.
8,579,203 B1 11/2013 Lambeth et al.
8,590,796 B1 11/2013 Cloutier et al.
8,602,312 B2 12/2013 Cloutier et al.
8,608,083 B2 12/2013 Mullen et al.
8,622,309 B1 1/2014 Mullen et al.
8,628,022 B1 1/2014 Rhoades et al.
8,668,143 B2 3/2014 Mullen et al.
8,727,219 B1 5/2014 Mullen
8,733,638 B2 5/2014 Mullen et al.
8,746,579 B1 6/2014 Cloutier et al.
8,757,483 B1 6/2014 Mullen et al.
8,757,499 B2 6/2014 Cloutier et al.
8,814,050 B1 8/2014 Mullen et al.
8,827,153 B1 9/2014 Rhoades et al.
8,875,999 B2 11/2014 Mullen et al.
8,881,989 B2 11/2014 Mullen et al.
8,931,703 B1 1/2015 Mullen et al.
8,944,333 B1 2/2015 Mullen et al.
8,973,824 B2 3/2015 Mullen et al.
9,004,368 B2 4/2015 Mullen et al.
9,010,630 B2 4/2015 Mullen et al.
9,053,398 B1 6/2015 Cloutier
9,064,255 B1 6/2015 Mullen et al.
9,292,843 B1 3/2016 Mullen et al.
9,306,666 B1 4/2016 Zhang et al.
9,329,619 B1 5/2016 Cloutier
9,349,089 B1 5/2016 Rhoades et al.
9,361,569 B2 6/2016 Mullen et al.
9,373,069 B2 6/2016 Cloutier et al.
9,384,438 B2 7/2016 Mullen et al.
9,547,816 B2 1/2017 Mullen et al.
9,639,796 B2 5/2017 Mullen et al.
9,646,240 B1 5/2017 Mullen et al.
9,652,436 B1 5/2017 Yen et al.
9,684,861 B2 6/2017 Mullen et al.
D792,511 S 7/2017 Mullen et al.
D792,512 S 7/2017 Mullen et al.
D792,513 S 7/2017 Mullen et al.
9,697,454 B2 7/2017 Mullen et al.
9,704,088 B2 7/2017 Mullen et al.
9,704,089 B2 7/2017 Mullen et al.
9,721,201 B1 8/2017 Mullen et al.
9,727,813 B2 8/2017 Mullen et al.
9,805,297 B2 10/2017 Mullen et al.
9,818,125 B2 11/2017 Mullen et al.
9,836,680 B1 12/2017 Cloutier
9,852,368 B1 12/2017 Yen et al.
9,875,437 B2 1/2018 Cloutier et al.
9,881,245 B1 1/2018 Rhoades et al.
9,928,456 B1 3/2018 Cloutier et al.
9,953,255 B1 4/2018 Yen et al.
10,022,884 B1 7/2018 Cloutier
10,032,100 B2 7/2018 Mullen et al.
10,055,614 B1 8/2018 Cloutier et al.
10,095,970 B1 10/2018 Mullen
10,095,974 B1 10/2018 Mullen et al.
10,169,692 B2 1/2019 Mullen et al.
10,176,419 B1 1/2019 Cloutier et al.
10,176,423 B1 1/2019 Mullen et al.
10,181,097 B1 1/2019 Mullen et al.
10,198,687 B2 2/2019 Mullen et al.
10,223,631 B2 3/2019 Mullen et al.
10,255,545 B2 4/2019 Mullen et al.
10,325,199 B2 6/2019 Mullen et al.
10,430,704 B2 10/2019 Mullen et al.
10,467,521 B2 11/2019 Mullen et al.
10,482,363 B1 11/2019 Cloutier et al.
10,496,918 B2 12/2019 Mullen et al.
10,504,105 B2 12/2019 Mullen et al.
10,579,920 B2 3/2020 Mullen et al.
10,693,263 B1 6/2020 Mullen et al.
10,936,926 B1 3/2021 Rhoades et al.
2002/0124699 A1 * 9/2002 Ishii et al. ..... 83/35
2003/0121386 A1 * 7/2003 Davis et al. ..... 83/684
2004/0129788 A1 * 7/2004 Takahashi ..... G06K 19/14 235/492
2008/0029607 A1 2/2008 Mullen
2008/0035738 A1 2/2008 Mullen
2008/0054068 A1 3/2008 Mullen
2008/0054079 A1 3/2008 Mullen
2008/0054081 A1 3/2008 Mullen
2008/0065555 A1 3/2008 Mullen
2008/0110308 A1 * 5/2008 Iwashita ..... B21D 28/02 83/13
2008/0302869 A1 12/2008 Mullen
2008/0302876 A1 12/2008 Mullen
2009/0159663 A1 6/2009 Mullen et al.
2009/0159667 A1 6/2009 Mullen et al.
2009/0159668 A1 6/2009 Mullen et al.
2009/0159669 A1 6/2009 Mullen et al.
2009/0159670 A1 6/2009 Mullen et al.
2009/0159671 A1 6/2009 Mullen et al.
2009/0159672 A1 6/2009 Mullen et al.
2009/0159673 A1 6/2009 Mullen et al.
2009/0159680 A1 6/2009 Mullen et al.
2009/0159681 A1 6/2009 Mullen et al.
2009/0159682 A1 6/2009 Mullen et al.
2009/0159688 A1 6/2009 Mullen et al.
2009/0159689 A1 6/2009 Mullen et al.
2009/0159690 A1 6/2009 Mullen et al.
2009/0159696 A1 6/2009 Mullen
2009/0159697 A1 6/2009 Mullen et al.
2009/0159698 A1 6/2009 Mullen et al.
2009/0159699 A1 6/2009 Mullen et al.
2009/0159700 A1 6/2009 Mullen et al.
2009/0159701 A1 6/2009 Mullen et al.
2009/0159702 A1 6/2009 Mullen
2009/0159703 A1 6/2009 Mullen et al.
2009/0159704 A1 6/2009 Mullen et al.

(56) References Cited

U.S. PATENT DOCUMENTS

2009/0159705 A1 6/2009 Mullen et al.
2009/0159706 A1 6/2009 Mullen et al.
2009/0159707 A1 6/2009 Mullen et al.
2009/0159708 A1 6/2009 Mullen et al.
2009/0159709 A1 6/2009 Mullen
2009/0159710 A1 6/2009 Mullen et al.
2009/0159711 A1 6/2009 Mullen et al.
2009/0159712 A1 6/2009 Mullen et al.
2009/0159713 A1 6/2009 Mullen et al.
2009/0160617 A1 6/2009 Mullen et al.
2009/0223273 A1* 9/2009 Erlenmaier ..... B21D 28/24 72/407
2009/0308921 A1 12/2009 Mullen
2011/0272465 A1 11/2011 Mullen et al.
2011/0272466 A1 11/2011 Mullen et al.
2011/0272467 A1 11/2011 Mullen et al.
2011/0272471 A1 11/2011 Mullen
2011/0272472 A1 11/2011 Mullen
2011/0272473 A1 11/2011 Mullen et al.
2011/0272474 A1 11/2011 Mullen et al.
2011/0272475 A1 11/2011 Mullen et al.
2011/0272476 A1 11/2011 Mullen et al.
2011/0272477 A1 11/2011 Mullen et al.
2011/0272478 A1 11/2011 Mullen
2011/0272479 A1 11/2011 Mullen
2011/0272480 A1 11/2011 Mullen et al.
2011/0272481 A1 11/2011 Mullen et al.
2011/0272482 A1 11/2011 Mullen et al.
2011/0272483 A1 11/2011 Mullen et al.
2011/0272484 A1 11/2011 Mullen et al.
2011/0276380 A1 11/2011 Mullen et al.
2011/0276381 A1 11/2011 Mullen et al.
2011/0276416 A1 11/2011 Mullen et al.
2011/0276424 A1 11/2011 Mullen
2011/0276425 A1 11/2011 Mullen
2011/0276436 A1 11/2011 Mullen et al.
2011/0276437 A1 11/2011 Mullen et al.
2011/0278364 A1 11/2011 Mullen et al.
2011/0282753 A1 11/2011 Mullen et al.
2011/0284632 A1 11/2011 Mullen et al.
2011/0284640 A1 11/2011 Mullen et al.
2012/0028702 A1 2/2012 Mullen et al.
2012/0037709 A1 2/2012 Cloutier et al.
2012/0197708 A1 8/2012 Mullen et al.
2012/0209744 A1 8/2012 Mullen et al.
2012/0254037 A1 10/2012 Mullen
2012/0254038 A1 10/2012 Mullen
2012/0286037 A1 11/2012 Mullen et al.
2012/0286928 A1 11/2012 Mullen et al.
2012/0286936 A1 11/2012 Mullen et al.
2012/0290449 A1 11/2012 Mullen et al.
2012/0290472 A1 11/2012 Mullen et al.
2012/0318871 A1 12/2012 Mullen et al.
2012/0326013 A1 12/2012 Cloutier et al.
2013/0020396 A1 1/2013 Mullen et al.
2013/0282573 A1 10/2013 Mullen et al.
2013/0282575 A1 10/2013 Mullen et al.
2014/0054384 A1 2/2014 Cloutier et al.
2015/0186766 A1 7/2015 Mullen et al.
2016/0162713 A1 6/2016 Cloutier et al.
2016/0180209 A1 6/2016 Mullen et al.
2016/0239735 A1 8/2016 Mullen et al.
2016/0283837 A1 9/2016 Mullen et al.
2016/0307085 A1 10/2016 Mullen et al.
2016/0335529 A1 11/2016 Mullen et al.
2016/0342876 A1 11/2016 Mullen et al.
2016/0342877 A1 11/2016 Mullen et al.
2016/0342878 A1 11/2016 Mullen et al.
2016/0342879 A1 11/2016 Mullen et al.
2016/0342880 A1 11/2016 Mullen et al.
2017/0286817 A1 10/2017 Mullen et al.
2017/0300796 A1 10/2017 Mullen et al.
2018/0053079 A1 2/2018 Cloutier et al.
2018/0060881 A1 3/2018 Mullen et al.
2019/0042903 A1 2/2019 Cloutier et al.
2019/0065928 A1 2/2019 Mullen et al.
2019/0197387 A1 6/2019 Mullen et al.
2019/0340484 A1 11/2019 Mullen et al.
2020/0082383 A1 3/2020 Mullen et al.

* cited by examiner

300

600

SYSTEMS AND METHODS FOR TRIMMING POWERED CARDS AND DEVICES

CROSS-REFERENCE TO RELATED APPLICATION

This application claims the benefit of U.S. Provisional Patent Application No. 61/536,907, titled "SYSTEMS AND METHODS FOR TRIMMING POWERED CARDS AND DEVICES," filed Sep. 20, 2011, which is hereby incorporated by reference herein in its entirety.

BACKGROUND OF THE INVENTION

This invention relates to powered cards and devices and related systems.

SUMMARY OF THE INVENTION

A card may include a dynamic magnetic communications device, which may take the form of a magnetic encoder or a magnetic emulator. A magnetic encoder, for example, may be utilized to modify information that is located on a magnetic medium, such that a magnetic stripe reader may then be utilized to read the modified magnetic information from the magnetic medium. A magnetic emulator, for example, may be provided to generate electromagnetic fields that directly communicate data to a read-head of a magnetic stripe reader. A magnetic emulator, for example, may communicate data serially to a read-head of the magnetic stripe reader. A magnetic emulator, for example, may communicate data in parallel to a read-head of the magnetic stripe reader.

All, or substantially all, of the front surface, as well as the rear surface, of a card may be implemented as a display (e.g., bi-stable, non bi-stable, LCD, or electrochromic display). Electrodes of a display may be coupled to one or more touch sensors, such that a display may be sensitive to touch (e.g., using a finger or a pointing device) and may be further sensitive to a location of the touch. The display may be sensitive, for example, to objects that come within a proximity of the display without actually touching the display.

Input and/or output devices may be included on a card, for example, to facilitate data exchange with the card. For example, an integrated circuit (IC) may be included on a card and exposed from the surface of the card. Such a chip (e.g., an EMV chip) may communicate information to a chip reader (e.g., an EMV chip reader). An RFID antenna or module may be included on a card, for example, to send and/or receive information between an RFID reader and the RFID included on the card.

A card may include multiple buttons and each button may be associated with a different product or feature. Alternatively, for example, a card may include a single button, but that single button may be used to, for example, toggle between multiple products. For example, pressing a button on a card a first time may cause a first payment product to be communicated via a dynamic magnetic stripe communications device. Pressing that button on that card a second time may, for example, cause a second payment product to be communicated via that dynamic magnetic stripe communications device. Accordingly, a user may utilize a single button to toggle between multiple payment products. Such payment products may include a debit product, credit product, gift product, pre-paid product, or any other type of product. For example, a card may include two credit accounts, where each credit account may be associated with a different association (e.g., Discover, MasterCard, Visa, American Express) or each credit account may be associated with the same association.

A card may be assembled as a combination of two or more circuit boards. A dynamic magnetic stripe communications device may, for example, be fabricated and assembled on a first circuit board while a second circuit board may be fabricated and assembled having other circuitry. For example, a card's processor, dynamic magnetic communications device driver circuitry, user interfaces, read-head detectors, light emitting devices, displays, batteries, and any other type of sensor, device, or associated circuitry may be fabricated on one or more other circuit boards.

A dynamic magnetic communications device may be fabricated on a flexible circuit board, for example, by providing a multiple layer flexible board (e.g., a two layer flexible printed circuit board). A coil for each track of information may be provided by including wire segments on each layer and interconnecting these wire segments through layer interconnections to create a coil. For example, a dynamic magnetic communications device may include two coils such that two tracks of information may be communicated to two different read-heads included in a read-head housing of a magnetic stripe reader. A dynamic magnetic communications device may include three coils such that three tracks of information may be communicated serially to three different read-heads included in a read-head housing of a magnetic stripe reader.

In manufacturing multiple boards dedicated to particular functions, functionality and reliability of each board may be verified separately before assembling. Once verified, one or more of the circuit boards may be mechanically and/or electrically coupled together via, for example, epoxy or conductive tape to form, for example, an electronics package.

During manufacture, the electronics package may include circuitry, such as one or more printed circuit boards, one or more dynamic magnetic communications devices, one or more processors, one or more displays, one or more buttons, and one or more batteries. The electronics package may be fixed (e.g., glued) to a lamination layer (e.g., a silicon-based layer or a polyurethane-based layer), a material may be injected onto the electronics package, and an additional lamination layer may be applied to the electronics package to form a laminate structure. The injection material may be formed from one or more polyurethane-based or silicon-based substances. The injection material may be a substance that changes its physical state (e.g., changes from a liquid substance to a solid substance) when cured by one or more conditions (e.g., air, heat, pressure, light, or chemicals) for a period of time.

The laminated card may be provided to a personalization facility for personalization. During personalization, for example, a customer's personal data may be placed on the exterior of the card (e.g., printed, embossed, or laser etched) as well as programmed into a memory of the card (e.g., a memory contained within a processor of the card).

The process that may be used to laminate a card assembly may yield a card assembly having non-conforming dimensions. Accordingly, a laminated card assembly may require trimming, such that geometric dimensions of the trimmed card assembly may meet predetermined physical characteristics. A first trimming process may, for example, be used as a coarse trimming process to trim the laminated card assembly within certain coarse dimensions. A second trimming process may, for example, be used as a fine trimming process to trim the laminated card assembly to its final dimensions.

A fine trimming process may, for example, be implemented with a punch machine. The punch machine may include a punch that may accept a coarsely trimmed card assembly (e.g., a card assembly manually trimmed using scissors). A punch machine may include a die that is matched to a punch within the punch machine, so that upon activation of the punch machine, the punch may engage the die to trim the card assembly to conforming dimensions.

Automated processes may be utilized to trim card assemblies in large quantities. A sheet of cards may, for example, be produced having multiple cards (e.g., 10 cards) per sheet. Each card within the sheet of cards may exhibit punch alignment cues. One or more of the punch alignment queues within the one or more card assemblies may be used to automatically align the sheet of card assemblies within a punch machine. Accordingly, the sheet of card assemblies may be automatically positioned within the punch machine so that each card assembly may be singulated from the sheet of card assemblies. Each singulated card assembly may also be trimmed to conforming physical dimensions by the punch machine.

A sheet of cards may be supplied to the punch machine via, for example, a conveyer belt. The conveyer belt may, for example, provide multiple degrees of freedom of movement (e.g., forward, backward, and sideways) to allow positioning of the sheet prior to trimming. A control system may be utilized within the punch machine, so that feedback provided by the control system may control a position of the conveyer belt. A control system may be utilized within the punch machine, so that feedback provided by the control system may control a position of the die and punch within the punch machine. Accordingly, a control system may be utilized to properly align one or more card assemblies within the punch machine so that each card assembly may be trimmed to conforming dimensions.

A sheet of cards may, for example, be sequentially collected within a reel. To singulate each card from the sheet, the sheet may be feed into a set of positioners (e.g., servo-driven positioners), unrolled to expose a single card within the sheet, where the exposed single card may then be singulated from the sheet. Excess sheet material may then be collected onto a disposable reel, where scrap material produced after singulation of the cards may be kept.

A punch machine may include an optical scanning device. The optical scanning device may, for example, scan for the location of punch alignment queues, such as notches, visible queues printed on a card assembly, or any other type of visual queue, that may exist within a card assembly and may provide feedback as to whether the card assembly is properly aligned within the punch machine for proper trimming. In so doing, for example, an operator of the punch machine may place a card assembly into the punch machine and may manually align the card assembly by adjusting the card assembly until it becomes aligned with one or more targets. Accordingly, for example, a display device of the punch machine may provide visual feedback to the operator to allow the operator to determine whether the card assembly is properly positioned within the punch machine. Once positioned properly, the operator may activate the punch machine to trim the card assembly to conforming physical dimensions.

A punch machine may employ a lifting system (e.g., a pneumatic lifting mechanism) that may be used to engage a punch and a die of the punch machine. A pneumatic system may, for example, include a Venturi device that may utilize air flow from the pneumatic system to create suction. Accordingly, a card assembly placed within the punch machine (e.g., on a punch of the punch machine) may be held in place by the suction created by the Venturi device during a trimming process performed on the card assembly.

A punch and/or a die of the punch machine may be angled, or otherwise offset, with respect to one another. Accordingly, a card assembly that may be attached to the punch or die during a trimming process may be engaged by the punch or die at various points along a perimeter of the card assembly at different times. In so doing, for example, the entire perimeter of the card assembly may not be trimmed simultaneously. Instead, each point along a perimeter of the card assembly may be trimmed sequentially so that only one point along a perimeter of the card assembly may be subject to trimming forces at any given point in time.

BRIEF DESCRIPTION OF THE DRAWINGS

The principles and advantages of the present invention can be more clearly understood from the following detailed description considered in conjunction with the following drawings, in which the same reference numerals denote the same structural elements throughout, and in which.

DETAILED DESCRIPTION OF THE INVENTION

Figure 1:
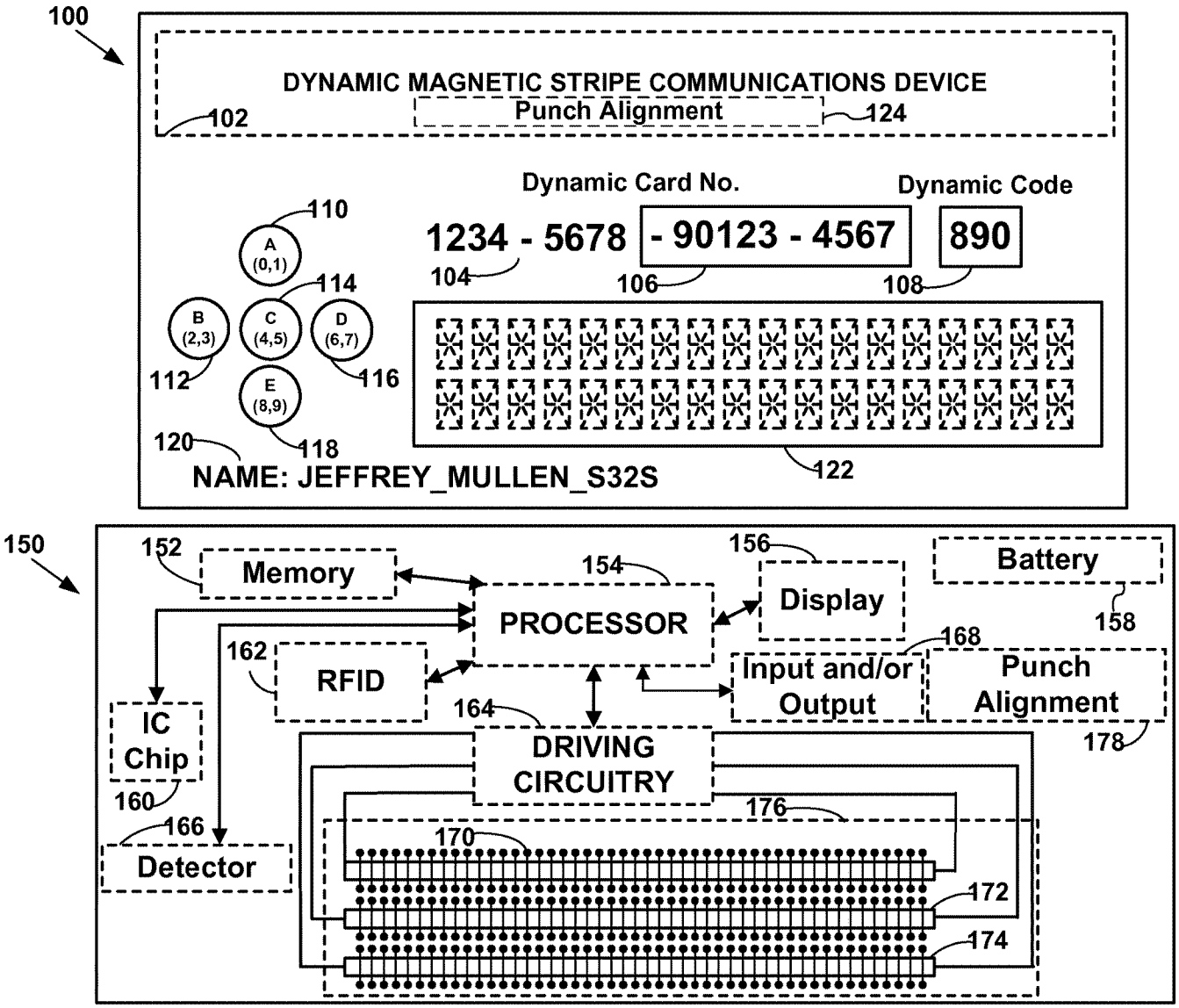
FIG. 1 is an illustration of a card constructed in accordance with the principles of the present invention.

FIG. 1 shows card 100 that may include, for example, a dynamic number that may be entirely, or partially, displayed using a display (e.g., display 106). A dynamic number may include a permanent portion such as, for example, permanent portion 104 and a dynamic portion such as, for example, dynamic portion 106. Card 100 may include a dynamic number having permanent portion 104 and permanent portion 104 may be incorporated on card 100 so as to be visible to an observer of card 100. For example, labeling techniques, such as printing, embossing, laser etching, etc., may be utilized to visibly implement permanent portion 104.

Card 100 may include a second dynamic number that may also be entirely, or partially, displayed via a second display (e.g., display 108). Display 108 may be utilized, for example, to display a dynamic code such as a dynamic security code. Card 100 may also include third display 122 that may be used to display graphical information, such as logos and barcodes. Third display 122 may also be utilized to display multiple rows and/or columns of textual and/or graphical information.

Persons skilled in the art will appreciate that any one or more of displays 106, 108, and/or 122 may be implemented as a bi-stable display. For example, information provided on displays 106, 108, and/or 122 may be stable in at least two different states (e.g., a powered-on state and a powered-off state). Any one or more of displays 106, 108, and/or 122 may be implemented as a non-bi-stable display. For example, the display is stable in response to operational power that is applied to the non-bi-stable display. Other display types, such as LCD or electrochromic, may be provided as well.

Other permanent information, such as permanent information 120, may be included within card 100, which may include user specific information, such as the cardholder's name or username. Permanent information 120 may, for example, include information that is specific to card 100 (e.g., a card issue date and/or a card expiration date). Information 120 may represent, for example, information that includes information that is both specific to the cardholder, as well as information that is specific to card 100.

Card 100 may accept user input data via any one or more data input devices, such as buttons 110-118. Buttons 110-118 may be included to accept data entry through mechanical distortion, contact, or proximity. Buttons 110-118 may be responsive to, for example, induced changes and/or deviations in light intensity, pressure magnitude, or electric and/or magnetic field strength. Such information exchange may then be determined and processed by a processor of card 100 as data input.

Dynamic magnetic stripe communications device 102 may, for example, provide one, two and/or three tracks of magnetic stripe data upon receiving data input from one or more buttons 110-118 (e.g., magnetic stripe data may be communicated after detection of a housing of a magnetic stripe reader and after receiving data input from a button). Punch alignment 124 may provide alignment information to a punch machine during a trimming process of card 100. Punch alignment 124 may, for example, provide visible information that may be detected by a punch machine so that a proper orientation of card 100 within the punch machine may be obtained prior to trimming card 100 to conforming dimensions.

FIG. 1 shows architecture 150, which may include one or more processors 154. One or more processors 154 may be configured to utilize external memory 152, internal memory of processor 154, or a combination of external memory 152 and internal memory for dynamically storing information, such as executable machine language, related dynamic machine data, and user input data values.

One or more of the components shown in architecture 150 may be configured to transmit information to processor 154 and/or may be configured to receive information as transmitted by processor 154. For example, one or more displays 156 may be coupled to receive data from processor 154. The data received from processor 154 may include, for example, at least a portion of dynamic numbers and/or dynamic codes.

One or more displays 156 may be, for example, touch sensitive and/or proximity sensitive. For example, objects such as fingers, pointing devices, etc., may be brought into contact with displays 156 and/or in proximity to displays 156. Detection of object proximity or object contact with displays 156 may be effective to perform any type of function (e.g., transmit data to processor 154). Displays 156 may have multiple locations that are able to be determined as being touched, or determined as being in proximity to an object.

Input and/or output devices may be implemented on architecture 150. For example, integrated circuit (IC) chip 160 (e.g., an EMV chip) may be included within architecture 150, that can communicate information with a chip reader (e.g., an EMV chip reader). Radio frequency identification (RFID) module 162 may be included within architecture 150 to enable the exchange of information with an RFID reader.

Other input and/or output devices 168 may be included within architecture 150, for example, to provide any number of input and/or output capabilities. For example, other input and/or output devices 168 may include an audio device capable of receiving and/or transmitting audible information.

Other input and/or output devices 168 may include a device that exchanges analog and/or digital data using a visible data carrier. Other input and/or output devices 168 may include a device, for example, that is sensitive to a non-visible data carrier, such as an infrared data carrier or electromagnetic data carrier.

Persons skilled in the art will appreciate that a card (e.g., card 100 of FIG. 1) may, for example, be a self-contained device that derives its own operational power from one or more batteries 158. Furthermore, one or more batteries 158 may be included, for example, to provide operational power for a period of time (e.g., approximately 2-4 years). One or more batteries 158 may be included, for example, as rechargeable batteries.

Electromagnetic field generators 170-174 may be included within architecture 150 to communicate information to, for example, a read-head of a magnetic stripe reader via, for example, electromagnetic signals. For example, electromagnetic field generators 170-174 may be included to communicate one or more tracks of electromagnetic data to read-heads of a magnetic stripe reader. Electromagnetic field generators 170-174 may include, for example, a series of electromagnetic elements, where each electromagnetic element may be implemented as a coil wrapped around one or more materials (e.g., a magnetic material and/or a non-magnetic material). Additional materials may be placed outside the coil (e.g., a magnetic material and/or a non-magnetic material).

Electrical excitation by processor 154 of one or more coils of one or more electromagnetic elements via, for example, driving circuitry 164 may be effective to generate electromagnetic fields from one or more electromagnetic elements. One or more electromagnetic field generators 170-174 may be utilized to communicate electromagnetic information to, for example, one or more read-heads of a magnetic stripe reader.

Punch alignment 178 may exist within architecture 150 as a visible, audible, and/or an electronically detectable positioning queue that may be used by a punch machine during a trimming process of a card (e.g., card 100 of FIG. 1). Accordingly, machinery (e.g., automated machinery) such as a trimming machine and/or a singulation machine may use punch alignment 178 to determine a substantially precise placement of the card within the punch machine. Accordingly, components of the card (e.g., dynamic magnetic stripe communications device 102 of card 100 of FIG. 1) may be properly aligned with respect to one or more dimensions of the card (e.g., a proper distance between dynamic magnetic stripe communications device 102 of card 100 of FIG. 1 and an edge of card 100 may be implemented).

RFID module 162 may communicate punch alignment information. For example, RFID module 162 may communicate a position of one or more components of a card (e.g., punch alignment 124 of card 100 of FIG. 1) to a punch machine. Accordingly, a punch machine may accurately align a punch, a die, and/or a conveyor belt during the singulation and/or trimming process of the card based upon the alignment signals received from RFID module 162.

Timing aspects of information exchange between architecture 150 and the various I/O devices implemented on architecture 150 may be determined by processor 154. One or more detectors 166 may be utilized, for example, to sense the proximity, mechanical distortion, or actual contact, of an external device, which in turn, may trigger the initiation of a communication sequence. The sensed presence or touch of the external device may then be communicated to a controller (e.g., processor 154), which in turn may direct the exchange of information between architecture 150 and the external device. The sensed presence, mechanical distortion, or touch of the external device may be effective to, for example, determine the type of device or object detected.

For example, the detection may include the detection of, for example, a read-head housing of a magnetic stripe reader. In response, processor 154 may activate one or more electromagnetic field generators 170-174 to initiate a communications sequence with, for example, one or more read-heads of a magnetic stripe reader. The timing relationships associated with communications between one or more electromagnetic field generators 170-174 and one or more read-heads of a magnetic stripe reader may be provided through use of the detection of the magnetic stripe reader.

Persons skilled in the art will appreciate that processor 154 may provide user-specific and/or card-specific information through utilization of any one or more of buttons 110-118, RFID 162, IC chip 160, electromagnetic field generators 170-174, and other input and/or output devices 168.

Figure 2:
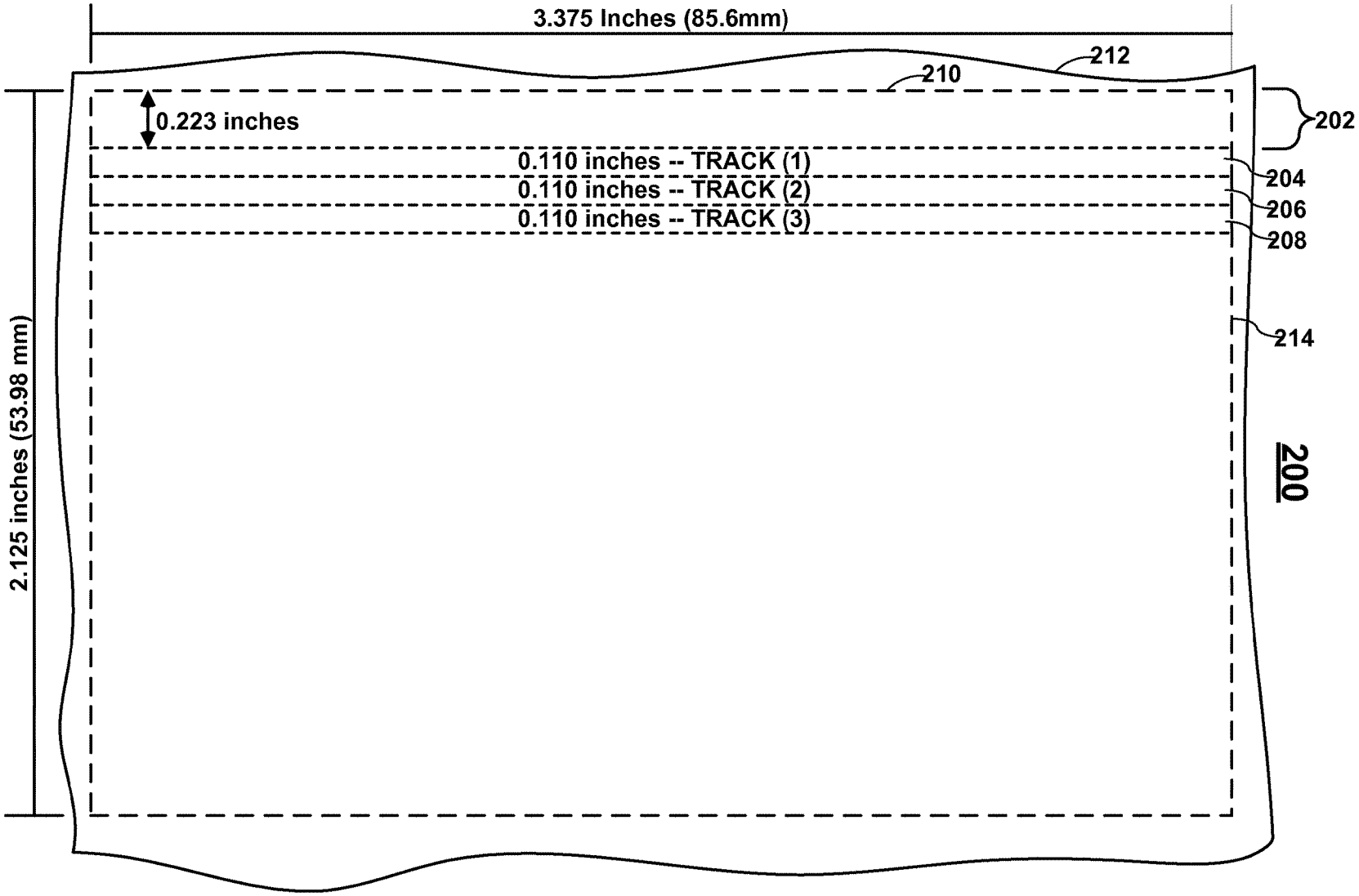
FIG. 2 is an illustration of a card constructed in accordance with the principles of the present invention.

FIG. 2 shows card 200. Card 200 may, for example, be a card having undergone a coarse trimming process to produce perimeter 212 having non-conforming dimensions. A punch machine may be used during a fine trimming process to define perimeter 214 having conforming dimensions. A distance between an edge of card 200 (e.g., edge 210 of perimeter 214) and track 1 of a magnetic stripe may be substantially equal to dimension 202, which may be approximately between 0.220 and 0.225 inches (e.g., 0.223 inches). In addition, a track height of tracks 204, 206, and 208 may be approximately between 0.109 and 0.111 inches (e.g., 0.110 inches).

Tracks 1, 2, and/or 3 may be the track locations of one or more magnetic encoders. Accordingly, a magnetic medium may be placed onto card 200 substantially in locations 204, 206, and/or 208, such that one or more magnetic encoders may change magnetic information stored within tracks 1, 2, and/or 3 of such a magnetic medium. Such changed information may then be read by a magnetic stripe reader.

Tracks 1, 2, and/or 3 may be the track locations of one or more magnetic emulators. Accordingly, one or more coils of such magnetic emulators may be placed substantially at locations 204, 206, and/or 208. In so doing, such magnetic emulators may generate electromagnetic fields that may communicate data to a read-head of a magnetic stripe reader.

Figure 3:
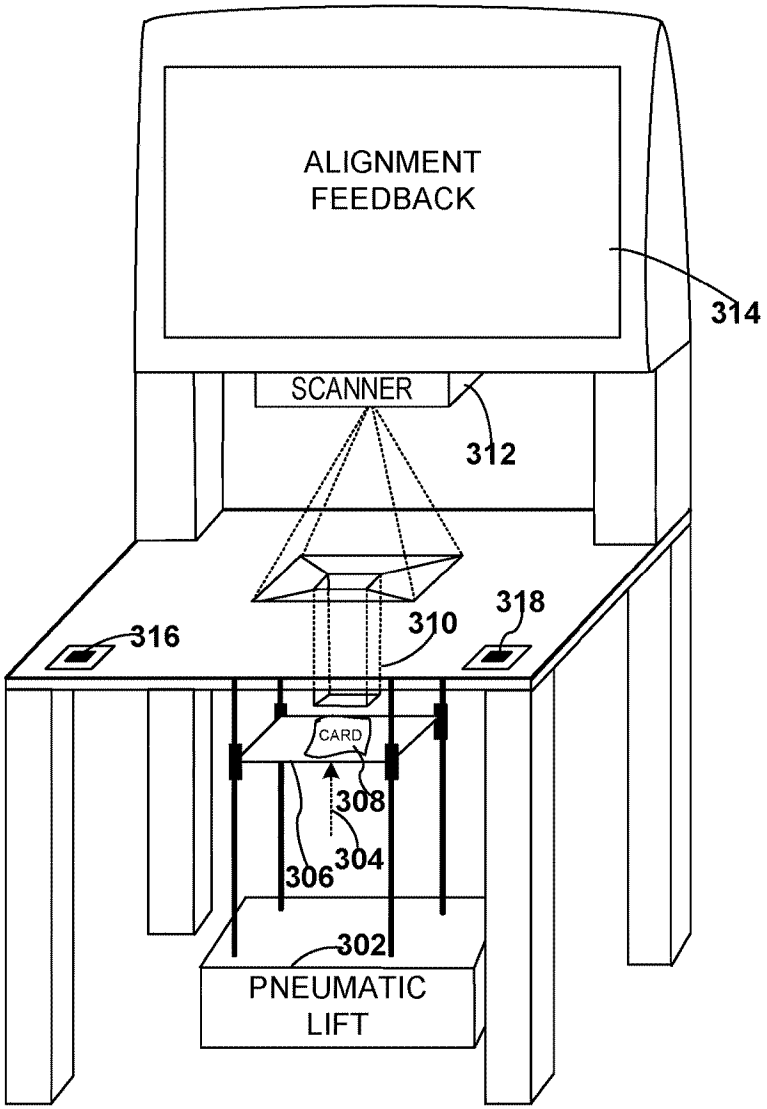
FIG. 3 is an illustration of a punch machine constructed in accordance with the principles of the present invention.

FIG. 3 shows punch machine 300 that may include pneumatic lift 302, punch 306, die 310, activation buttons 316-318, scanner 312, and display 314. Pneumatic lift 302 may be actuated by activation buttons 316 and/or 318 to raise punch 306 in direction 304 so that card 308 be engage die 310. Upon engagement of card 308 with die 310, card 308 may be trimmed to conforming dimensions by die 310. A safety mechanism may be incorporated within punch machine 300, such that both activation button 316 and activation button 318 may need to be pressed simultaneously before punch 306 may be raised in direction 304.

Punch machine may include scanner 312. Scanner 312 may, for example, provide visibility to card 308 and may provide alignment feedback onto display 314. Accordingly, for example, an operator may place card 308 onto punch 306, while scanner 312 monitors the placement of card 308 in relation to die 310. In so doing, the operator may change the placement of card 308 on punch 306 in response to the monitored placement of card 308 by display 314.

Alignment feedback provided to display 314 may, for example, scan the position of punch alignment queues integrated within card 308 and may display the position of the punch alignment queues relative to target locations that may also be provided to display 314. By aligning the punch alignment queues integrated within card 308 as provided onto display 314 with target locations also provided onto display 314, the operator may properly align card 308 relative to die 310 so that card 308 may be trimmed to conforming dimensions.

Figure 4:
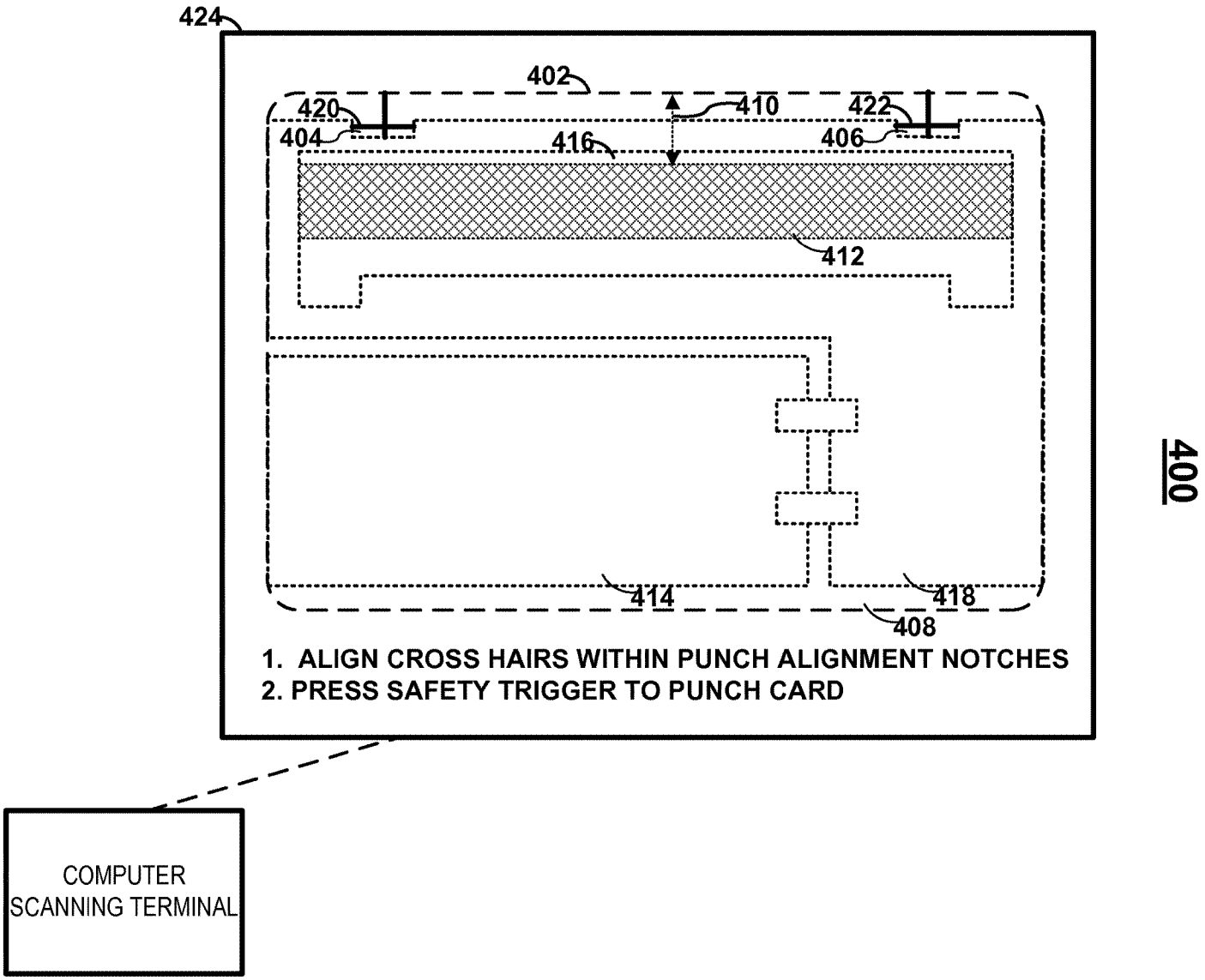
FIG. 4 is an illustration of a scanning terminal constructed in accordance with the principles of the present invention.

FIG. 4 shows computer scanning terminal 400, which may project onto display 424 a scanned image of card 408 that may be mounted to a punch of a punch machine. For example, a punch machine may be equipped with scanning capability so that a scanned image of card 408 that may be mounted within the punch machine may be provided to a display of the punch machine. In so doing, the scanned feedback provided to the operator may allow the operator to properly align card 408 within the punch machine.

The scanned image may include outline 402 that may depict a post-trim perimeter of card 408 that may exist once card 408 is trimmed by the punch machine. The scanned image may also include punch alignment queues of card 408 that may exist internally within card 408, since card 408 may be laminated with transparent or translucent material. The scanned image may also include punch alignment queues of card 408 that may exist on one or more external surfaces of card 408. In so doing, card 408 may be laminated with opaque material and may include punch alignment queues on an exterior surface so as to be visible. Punch alignment queues may, for example, consist of one or more components mounted to card 408. Accordingly, an operator of a punch machine may view a scanned image of card 408 that may be mounted to a punch of the punch machine and aligned in preparation for a trimming process to be performed on card 408.

Card 408 may include one or more boards (e.g., boards 414, 416, and 418). Boards 414, 416, and/or 418, may contain, for example, a processor, a battery, a display, a button, and any other component that may be provided on a card or other device such as a mobile telephonic device. Card 408 may include dynamic magnetic stripe communications device 412. Positioning of dynamic magnetic stripe communications device 412 relative to outline 402 may be established by a punch machine so that a dimension (e.g., distance 410 between outline 402 and dynamic magnetic stripe communications device 412) may be held to a conforming distance.

Punch alignment queues (e.g., notches 404 and 406) or any other type of queue, such as printed symbols or characters, embossed symbols or characters, laser-etched symbols or characters, electronic alignment components, or other components mounted to card 408 may be provided within card 408, on card 408, or external to card 408, to aid in the alignment of card 408 within a punch machine. For example, computer scanning terminal 400 may project cross hairs 420 and 422 onto display 424. An operator may adjust a position of card 408 so that punch alignment queues 404 and 406, as scanned from card 408 and projected onto display 424, match up to cross hairs 420 and 422, respectively, substantially as shown. Once cross hairs 420 and 422 have been aligned within punch alignment queues 404 and 406, an operator of a punch machine may receive feedback from display 424 that card 408 has been properly aligned within the punch machine. The operator may then activate the punch machine to trim card 408 to dimensions that are substantially equal to perimeter 402.

Figure 5:
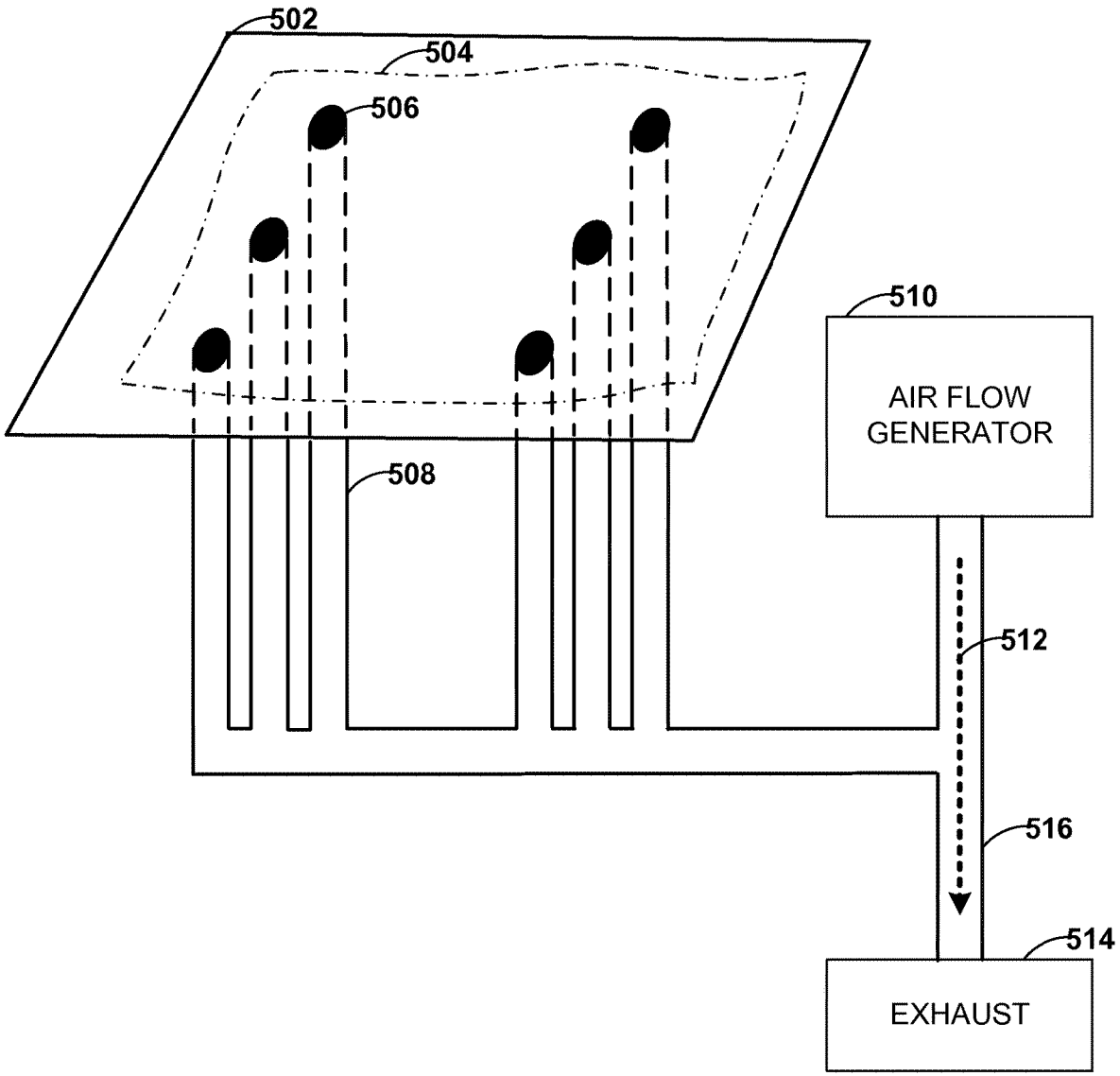
FIG. 5 is an illustration of a suction device constructed in accordance with the principles of the present invention.

FIG. 5 shows suction device 500, which may include punch 502, holes 506 within punch 502, tubes 508 connected to holes 506, air flow generator 510, and exhaust 514. Suction device 500 may, for example, be used to hold card 504 (or other device such as a mobile telephonic device) in place while punch 502 engages a die (not shown) to trim card or device 504. Suction device 500 may, for example, create airflow 512 via air flow generator 510 and exhaust 514. Persons skilled in the art will appreciate that airflow 512 may be created within a closed-loop system, so that airflow 512 does not exhaust, but is rather routed back to air flow generator 510 by the closed-loop system.

Air flow 512 may create a pressure differential such that air pressure that may exist within tube 516 may be lower than air pressure that may exist within tubes 508. Accordingly, suction may be created at holes 506, such that once card or device 504 is placed onto punch 502, suction created by airflow 512 may cause card or device 504 to temporarily adhere to punch 502. In so doing, once an operator places card or device 504 into proper alignment with punch 502 (e.g., as may be determined by the operator when inspecting a scanned image of card or device 504 on a display of a punch machine), card or device 504 may remain in place during a trimming process of card or device 504.

Figure 6:
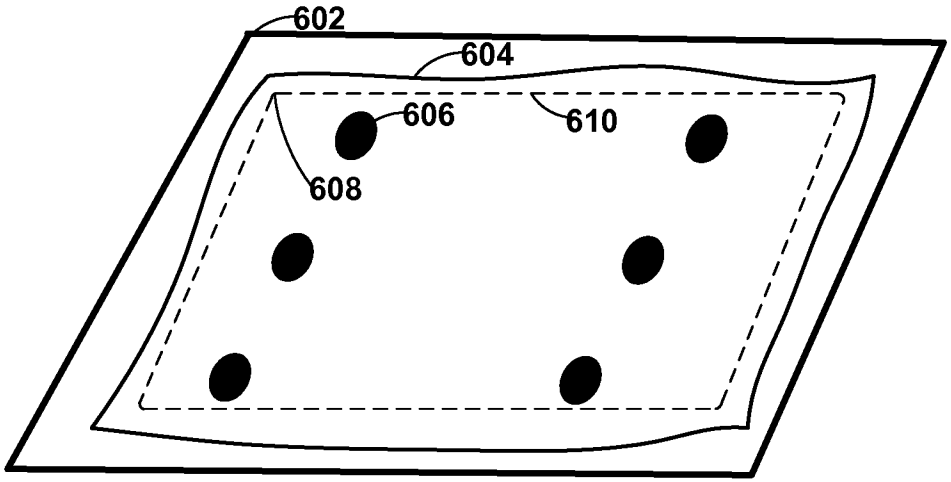
FIG. 6 is an illustration of a system constructed in accordance with the principles of the present invention.

FIG. 6 shows system 600, which may include punch 602, pre-trimmed card or device 604, and suction holes 606. A pre-trimmed card or device 604 may be placed onto punch 602 where suction created at suction holes 606 may temporarily adhere card or device 604 onto punch 602. Punch 602 may be engaged (e.g., pneumatically engaged) with a die (not shown) so as to trim card or device 604 to dimensions as may be defined by perimeter 610.

The die may engage punch 602 such that portions of card or device 604 may be trimmed sequentially along perimeter 610. Accordingly, a cutting surface of the die may be angled or offset with respect to a surface of punch 602, such that the die engages card or device 604 at a single position (e.g., position 608) along perimeter 610 upon initial contact. As punch 602 continues to be pressed against the die, card or device 604 may be trimmed along perimeter 610 in a sequential manner (e.g., trimmed along perimeter 610 in a counter-clockwise direction). In so doing, pressure may be exerted onto card or device 604 in a controlled manner (e.g., pressure is not exerted on the entire perimeter 610 simultaneously). Accordingly, pressure may be exerted only on certain portions of card or device 604 along perimeter 610 at any given instant, which may reduce an amount of stress exerted onto card or device 604, which may then reduce occurrences of stress-related failures that may be induced within card or device 604 during a trimming process.

Figure 7:
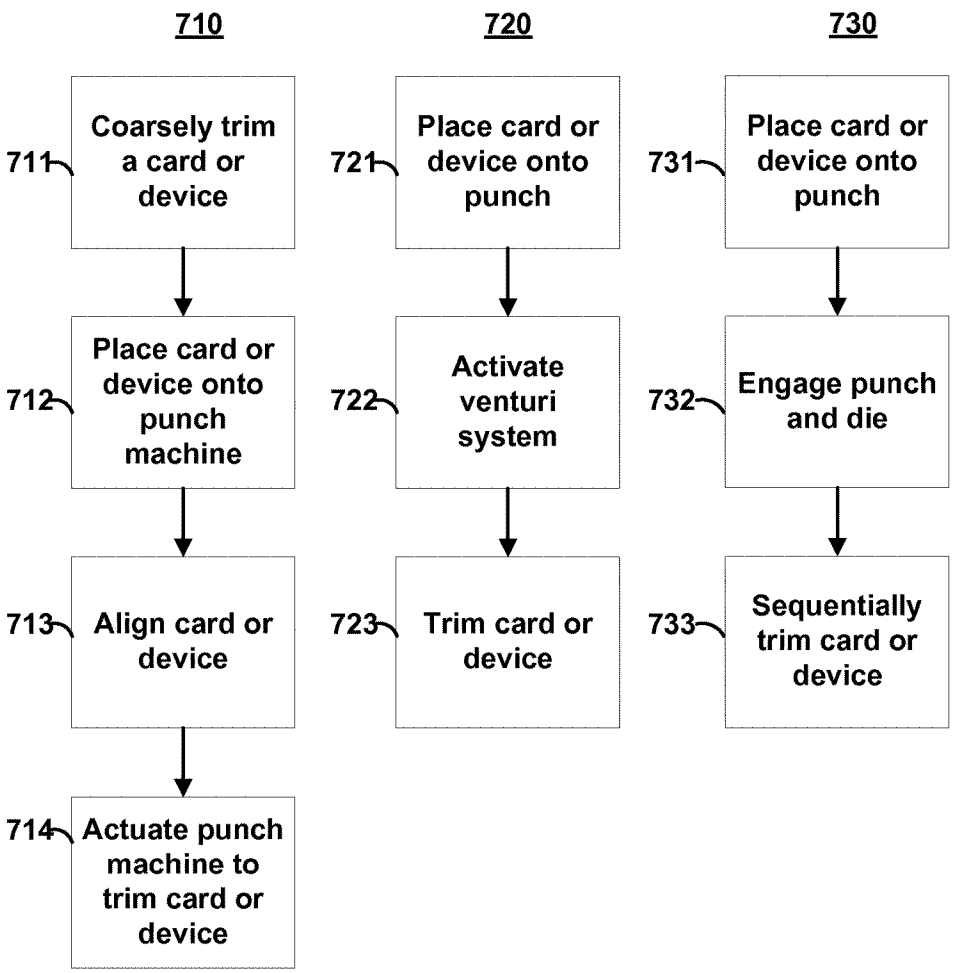
FIG. 7 is an illustration of process flow charts constructed in accordance with the principles of the present invention.

Multiple process flow charts are shown in FIG. 7. Step 711 of sequence 710 may include coarsely trimming a card or device after a lamination process is conducted to form the card or device. In step 712, the coarsely trimmed card or device may be placed onto a punch machine and aligned as in step 713. For example, a punch machine may include scanning capability, such that a position of a card or device may be scanned and the scanned image may be rendered onto a display of the punch machine. A position of the card or device may be changed to align with alignment targets (e.g., cross hairs) that may also be rendered onto the display. In so doing, by changing the alignment of the card or device while watching the scanned image of the card or device on the display, an operator may properly align the card or device to prepare the card or device to be trimmed (e.g., as in step 714).

In step 721 of sequence 720, a card or device may be placed onto a punch of a punch machine. The punch may include holes that may be connected to a suction system (e.g., a Venturi system). Accordingly, the Venturi system may be activated (e.g., as in step 722) to cause suction to exist at the holes of the punch. In so doing, the card or device may be temporarily adhered to the punch via the suction created by the Venturi system and then trimmed to conforming dimensions (e.g., as in step 723).

In step 731 of sequence 730, a card or device may be placed onto a punch of a punch machine. A die may be engaged with the punch (e.g., the punch may be pneumatically engaged with the die) so that the die may engage the card or device that is placed on the punch. A cutting surface of the die and a surface of the punch may be offset such that only portions of the card or device engage the die at any given instant. As the punch is further pressed onto the die, the card or device may be sequentially trimmed along a perimeter of the card or device (e.g., as in step 733), such that pressure may be applied only to specific portions along a perimeter of the card or device at any given instant. In so doing, pressure is not applied to the entire perimeter of the card or device simultaneously, so as to reduce a likelihood that the card or device may be damaged during the trimming process.

Figure 8:
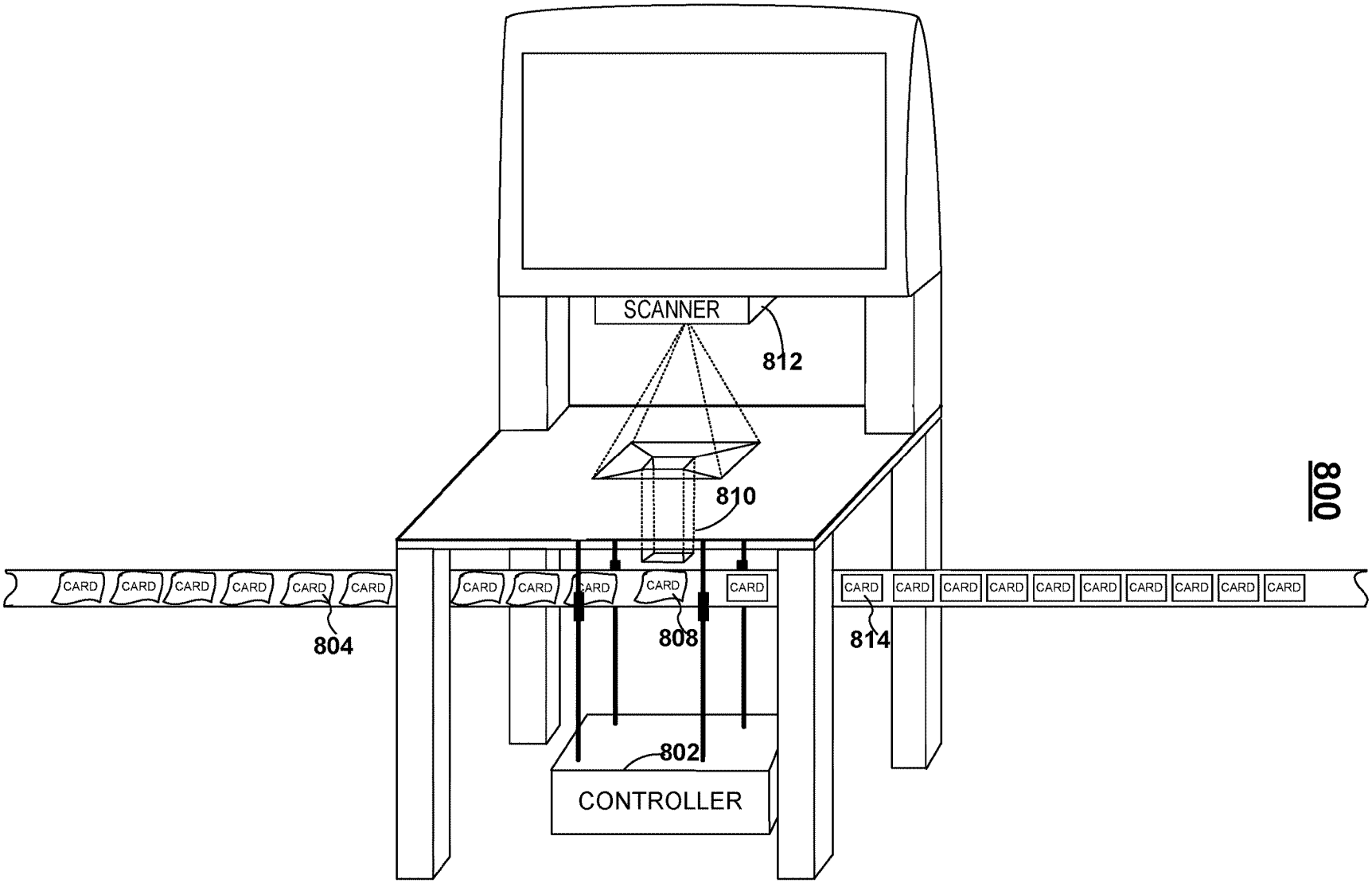
FIG. 8 is an illustration of an automated punch machine constructed in accordance with the principles of the present invention.

FIG. 8 shows automated punch machine 800 that may include controller 802, conveyor belt 804, die 810, and scanner 812. Controller 802 may, for example, control the position of conveyor belt 804 based on scan data that may be generated by scanner 812. For example, controller 802 may receive alignment information from scanner 812 and may modify a position of conveyor belt 804 until cards 808 are aligned properly with respect to die 810. Once aligned, controller 802 may cause conveyor belt 804 to engage die 810 to create trimmed cards 814. Once aligned, controller 802 may cause die 810 to engage conveyor belt 804 to create trimmed cards 814.

Persons skilled in the art will appreciate that cards 808 may exist within a sheet containing multiple cards. Accordingly, for example, controller 802 may adjust a position of conveyor belt 804 (or a position of die 810) so that each card within a sheet of cards may be properly aligned with respect to die 810 and singulated from their respective sheet.

Figure 9:
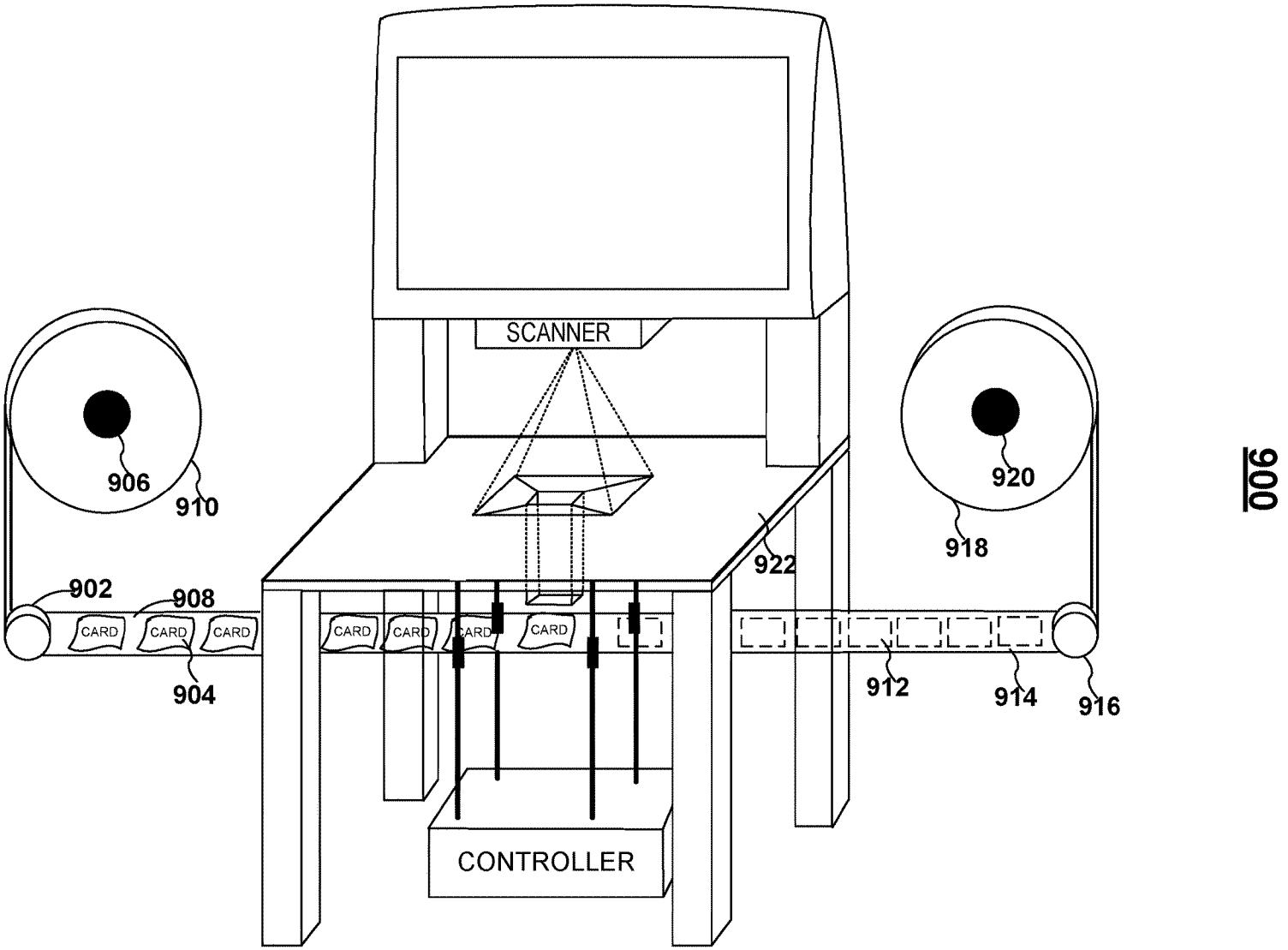
FIG. 9 is an illustration of an automated punch machine constructed in accordance with the principles of the present invention.

FIG. 9 shows automated punch machine 900 that may include reel 910, laminated sheets 908, cards or devices 904 between laminated sheets 908, reel 918, and singulator 922. Cards or devices 904 may be stored within a reel (e.g., reel 910). A continuous feed of material (e.g., laminated sheets 908) from reel 910 may contain card or device assemblies 904 that are laminated between the top and bottom sheets of laminated sheets 908. Pulleys 902 and 916 may, for example, support laminated sheets 908 as cards or devices 904 are presented to singulator 922 for singulation.

Persons skilled in the art will appreciate that laminated sheets 908 may form the conveyor belt required to present cards or devices 904 to singulator 922 for singulation. Alternately, for example, a conveyor belt and/or support assembly (not shown) may be used to support laminated sheets 908 and cards or devices 904 during the singulation process.

Reel 910 may, for example, be supported by axle 906 where the extraction of laminated sheets 908 from reel 910 may be facilitated by rotating reel 910 about axle 906. Laminated sheets 908 having cards or devices 904 may then feed into singulator 922 for singulation. For each card or device 904 singulated from laminated sheets 908, a hole 912 may be formed within a remaining portion of laminated sheets 908 (e.g., portion 914). Receiving reel 918 may then collect remaining portion 914 by rotating about axle 920.

Persons skilled in the art will also appreciate that the present invention is not limited to only the embodiments described. Instead, the present invention more generally involves dynamic information and the exchange thereof. Persons skilled in the art will also appreciate that the apparatus of the present invention may be implemented in other ways than those described herein. All such modifications are within the scope of the present invention, which is limited only by the claims that follow.

What is claimed is:

1. A punch machine, comprising:

a punch including at least one suction hole, said punch operable to hold and raise a device;

a die, operable to engage said device, wherein the punch is mounted under the die;

a scanner mounted above said die, said scanner operable to scan said device through said die;

a display; and at least one button, wherein said scanner projects an alignment of said device on said punch onto said display, and said punch is operable to raise said device into engagement with said die upon actuation of said at least one button.

2. The punch machine of claim 1, further comprising a pneumatic lifting mechanism to engage said die with said punch to trim said device.

3. The punch machine of claim 1, further comprising a pneumatic lifting mechanism to engage said die with said punch to trim said device when the at least one button is actuated.

4. The punch machine of claim 1, further comprising a pneumatic lifting mechanism to engage said die with said punch to trim said device when a first button and a second button of the at least one button are actuated.

5. The punch machine of claim 1, further comprising a pneumatic lifting mechanism to engage said die with said punch to trim said device when two buttons of the at least one button are actuated simultaneously.

6. The punch machine of claim 1, wherein said punch includes holes of the at least one suction hole that create suction to secure said device to said punch.

7. The punch machine of claim 1, further comprising a pneumatic lifting mechanism to engage said die with said punch to trim said device, wherein said punch and said die are offset with respect to each other to avoid trimming an entire perimeter of said device simultaneously.

8. The punch machine of claim 1, wherein said device is a payment card.

9. The punch machine of claim 1, wherein said punch is movable in a direction of said die.

* * * * *